United States Patent [19]
Hall et al.
[11] 4,451,292
[45] * May 29, 1984

[54] SINTERED HARDMETALS

[76] Inventors: Fred W. Hall, Metallurg Group Industrial Development Office, 64 Fargate, Sheffield, South Yorkshire, S1 2HE, England; Hans-Joachim Retelsdorf, Gesellschaft für Elektrometallurgie m.b.H., Zentrale Forschung, Postfach 2844, 8500 Nürnberg 1, Fed. Rep. of Germany

[ * ] Notice: The portion of the term of this patent subsequent to Nov. 29, 2000 has been disclaimed.

[21] Appl. No.: 305,625

[22] PCT Filed Mar. 4, 1981

[86] PCT No.: PCT GB81/00036

§ 371 Date: Sep. 17, 1981

§ 102(e) Date: Sep. 17, 1981

[87] PCT Pub No.: WO81/02588

PCT Date: Sep. 17, 1984

[30] Foreign Application Priority Data

Mar. 4, 1980 [GB] United Kingdom ..... 8007382

[51] Int. Cl.[3] ..... B22F 3/12; C22C 14/00; C22C 1/04

[52] U.S. Cl. ..... 75/238; 419/16; 419/15; 75/236; 75/242

[58] Field of Search ..... 75/236, 238, 241, 242, 75/203

[56] References Cited

U.S. PATENT DOCUMENTS

| | | | |
|---|---|---|---|
| Re. 22,166 | 8/1942 | Schwarzkopf | 75/236 |
| 3,779,745 | 12/1973 | Rudy | 75/176 |
| 3,971,656 | 7/1976 | Rudy | 75/238 |
| 4,049,876 | 9/1977 | Yamamoto | 75/242 |

FOREIGN PATENT DOCUMENTS

| | | |
|---|---|---|
| 637165 | 5/1950 | United Kingdom . |
| 674229 | 6/1952 | United Kingdom . |
| 708525 | 5/1954 | United Kingdom . |
| 1332451 | 3/1973 | United Kingdom . |

*Primary Examiner*—Brooks H. Hunt
*Assistant Examiner*—Anne Brookes
*Attorney, Agent, or Firm*—Young & Thompson

[57] ABSTRACT

Spinodally-decomposing mixed crystals of zirconium and titanium carbides, possibly including carbonitrides and optionally including one or more carbides of metals of Group Vb of the Periodic Table of the Elements, are used in making sintered hardmetals based on tungsten carbide. One or more iron group metals or alloys, preferably cobalt or a nickel alloy, is or are used as a binder. The sintered hardmetals are made by a 2-stage process, mixed crystal material comprising zirconium and titanium carbides being formed in the first stage and being combined with the binder and tungsten carbide in the second stage. Process variations which encourage spinodal decomposition of the mixed crystal material are also disclosed.

15 Claims, No Drawings

SINTERED HARDMETALS

DESCRIPTION

This invention relates to sintered hardmetals, which are mixed carbides of metals selected from Groups IVb to VIb of the Periodic Table of the Elements and possibly other metals, in conjunction with binder metals or alloys of the iron group. The hardmetals of the invention concern, in particular, tungsten carbide from Group VIb and the carbides of zirconium and titanium from Group IVb, optionally together with carbides of metals of Group Vb. The extreme hardness and wear-resistance of hardmetals generally make them very suitable for use as tools or tool tips, for use in machine tools, and for dies and components generally where wear-resistance is essential.

Hardmetals for the machining of materials producing short chips have consisted of tungsten carbide, WC, with cobalt as the customary iron group metal or alloy as a binder, for over five decades. For the machining of materials producing long chips, beneficial additions of titanium carbide, TiC, and tantalum carbide, TaC, have been used over the past three to four decades, leading to development and use of the now classic WC-TiC-Co and WC-TiC-TaC-Co hard metals. As substitutes for TaC, niobium carbide, NbC, hafnium carbide, HfC, and NbC/HfC mixed crystals have achieved a certain significance, whilst WC appears to be at least partly replaceable by isomorphous phases, such as MoC, Mo(C,N) and (Mo,W) (C,N), i.e. molybdenum carbide and carbonitride and mixed molybdenum/tungsten carbonitrides. Partial replacement of TiC and TaC by VC and CrC has, up to now, been accompanied by very little success.

A review of hardmetal literature has shown that, as well as the immiscible system VC-ZrC and VC-HfC, fully miscible systems having miscibility gaps are also known, for example TiC-ZrC, TiC-HfC, VC-NbC and VC-TaC. These mixed crystal systems undergo spinodal decomposition, but this property of these mixed crystals has not yet been used in hardmetal technology. Our prior discovery of the advantageous properties of mixed crystals of zirconium and hafnium carbides, described and claimed in our U.S. application Ser. No. 285,189 filed July 20, 1981 has enabled spinodally-decomposing systems of these carbides to be applied in hardmetal technology; our aforesaid specification discloses sintered hardmetals and processes for making them, which contain zirconium and hafnium carbides in mixed crystal form together with one or more carbides of metals of Groups IV to VI and a binder comprising one or more metals or alloys of the iron group.

It has now been suprisingly found that additions of spinodally-decomposing complex mixed crystals based on ZrC and TiC and, optionally, one or more Group Vb metal carbides to hard metals based on tungsten carbide produce very abrasion-resistant and finegrained hardmetal materials, which are eminently suitable for making cutting tools. These hardmetals and tools made from them are superior to classical WC-TiC-TaC-Co alloys both in respect of flank wear and crater wear.

Hardmetals containing ZrC have long been studied, especially with respect to the substitution of TiC by ZrC in WC-TiC-Co alloys. The ZrC is introduced as a ZrC-WC mixed crystal. Results are not encouraging, as an amount of ZrC twice that of the TiC has to be added to achieve a hardmetal of similar performance. Investigation into the partial replacement of TiC by ZrC has been considered, but has not been carried out up to now.

According to a first aspect of this invention, a sintered hardmetal comprise tungsten carbide, spinodally-decomposing mixed crystal containing zirconium and titanium carbides and a binder comprising one or more metals or alloys of the iron group.

According to an especially preferred feature of the invention, the spinodally-decomposing mixed crystal also includes one or more carbides of metals of Group Vb, especially one or more of the carbides of niobium, tantalum and vanadium.

According to a second aspect of this invention, a sintered hardmetal is manufactured by heating a first mixture comprising zirconium and titanium carbides and optionally one or more carbides of metals of Group Vb under such conditions that the resultant first product comprises mixed crystal capable of spinodally decomposing, forming a second mixture from the first product in comminuted form, tungsten carbide with or without at least one other hardmetal material and one or more metals or alloys of the iron group and heating the second mixture under such conditions that the resultant second product comprises a sintered hardmetal comprising spinodallydecomposed mixed crystal.

The invention also resides in tools, tool tips, dies or components made from sintered hardmetals of the invention.

Preferably, the amount of spinodallydecomposing mixed crystal incorporated into the sintered hardmetals of the invention lies in the range from 2% to 40% and, most preferably, in the range from 5% to 30%; these amounts and all amounts stated below are given by weight.

In accordance with an especially important preferred feature of the invention, the relative amounts of ZrC and TiC in the mixed crystal material incorporated in the products of the invention lie in the range, in molar proportions, from 5% to 80% ZrC to 95% to 20% TiC. It is also possible, according; to another preferred feature of the invention, for the mixed crystal material to contain hafnium carbide when present, HfC can constitute up to 40% by weight of the ZrC content of the mixed crystal material.

The sintered hardmetals of this invention have been derived from investigations which indicate that it is only the addition of a spinodally-decomposing mixed crystal, based upon zirconium and titanium carbides and optionally containing one or more Group Vb metal carbides and/or HfC, which produces a noticeable success. In the final sintered hardmetal based on WC, ZrC-TiC mixed crystal and a binder, a cubic ZrC-TiC mixed crystal rich in TiC is found, side-by-side with a cubic ZrC-TiC mixed crystal rich in ZrC. After sintering, the first phase contains up to 20% WC in solid solution and the latter phase up to 10% WC in solid solution. Machining performance and crater-resistance of these alloys are satisfactory, but it was felt that toughness left something to be desired, as it amounted only to 80%–90% of that of the classical WC-TiC-Co hardmetal. Further investigation involved the effect of introducing one or more Group Vb metal carbides (VC, NbC or TaC, especially, NbC) into the ZrC-TiC mixed crystal, preferably in the amount of 3%–30%, and it was discovered, also suprisingly, that this produces an increase in bend strength of 15%–25%. However, it has also been found that, by increasing the addition of the one or more Group Vb metal carbides to the ZrC-TiC mixed crystal to about 35%–50%, the miscibility gap closes, thus losing the grain-refining effect of the spinodal decomposition. Even so, the addition of Group Vb metal carbides in these higher amounts still has a positive effect, though no longer an optimum one; in view of the desirability of maintaining a miscibility gap to some extent, it is preferable for the amount of mixed crystal to be not more than 40% in most cases.

With regard to the addition of one or more Group Vb metal carbides, it is preferable always to add VC together with NbC and/or TaC in the proportion of 1:4 to 1:10, so as to maintain grain-refinement and increase in hardness without loss of toughness. NbC and TaC have similar effects, but NbC is preferred due to its lower specific gravity and its appreciably cheaper cost.

The following three examples illustrate the invention, though they are not intended to be limitative in effect. Amounts are given in parts by weight or percentages by weight.

EXAMPLE 1

For the machining of materials producing mainly short chips and for parts subject to abrasion, an alloy of 2.5% ZrC, 1.5% TiC, 0.2% VC, 0.8% NbC and 5% Co, remainder WC, was produced.

In the first stage of the process of manufacture, a mixed crystal was prepared by mixing 50% parts ZrC, 30 parts TiC, 4 parts VC and 16 parts NbC, all in the form of fine powder, and heating for 2 hours at 2100° C. The resultant comminuted cubic mixed crystal, grain size 2–3$\mu$, was found to be homogeneous when subjected to x-ray crystallographic examination. 5% of this mixed crystal product was mixed with 90% of WC (1$\mu$) and 5% Co, to form a second mixture, which was then wet-milled under alcohol, dried, pressed and sintered under vacuum for 1 hour at 1450°±25° C. The resulting product was found to have a hardness of 1700 VH and a bend strength of 150±10 kp/mm$^2$. X-ray examination of the carbides in the product showed the presence of hexagonal WC and two cubic phases, one rich in ZrC and the other rich in TiC.

EXAMPLE 2

For general use, an alloy of 5% ZrC, 5% TiC, 3% NbC, 79% WC and 8% Co was produced. In a first stage, a cubic mixed crystal product was prepared by wet-milling 5 parts of ZrC, 5 parts TiC, 3 parts NbC, 1.5 parts WC and 0.1 part Co, followed by drying, pressing and heating for 1 hour at 1950°±50° C., giving a homogeneous cubic mixed crystal. The amount of WC included in the first mixture corresponded approximately to the amount which would eventually enter the cubic mixed crystals on final sintering. The Co addition serves to accelerate mixed crystal formation by eutectic film development on the carbide surfaces.

In a second stage, 14.6 parts of the comminuted mixed crystal product were then wet-milled under acetone, after being incorporated into a second mixture with 8 parts of Co and 77.4 parts WC, the milled product then being dried, pressed and sintered under vacuum at 1425°±25° C. The resulting hardmetal had a hardness of 1550–1600 VH and a bend strength of 160–180 kp/mm$^2$. As in the case of the alloy (1) of Example 1, phase examination showed three carbide phases, i.e. the hexagonal WC and two cubic phases, together with the cubic Co phase.

EXAMPLE 3

For the machining of materials producing long chips, an alloy of 12% TiC, 8% ZrC, 7% NbC, 3% TaC, 10% (Mo,W) (C,N), 52% WC and 8% Co was produced, care being taken once more that the cubic TiC-ZrC-NbC-TaC mixed cyrstal produced from the initial mixture was homogeneous under X-ray examination and that, during the final sintering, it decomposed as completely as possible. The decomposition was promoted by the inclusion of the hexagonal (Mo,W) (C,N), which caused a partial nitrogencarbon exchange with the cubic phase during the final sintering.

The cubic mixed crystal was produced in a first stage by fine-milling a first mixture of 12 parts TiC, 8 parts ZrC, 7 parts NbC and 3 parts TaC and sintering for 2½ hours at 2000°±100° C. This yielded 30 parts of finely-milled cubic mixed crystal, which in the second phase were mixed with 52 parts hexagonal WC, 10 parts hexagonal (Mo,W) (C,N) and 8 parts Co. The milling in the second stage was effected under alcohol, followed by spray-drying under nitrogen. Pressings were made and then sintered under vacuum or under a low nitrogen pressure, e.g. 80 mm. Where the sintered products showed the microporosity associated with nitrogen, they were then hot isostatically re-pressed at 1400° C. under an argon pressure of 500 atms. The hardness of the sintered articles was 1700 ±50 VH and the bend strength ranged from 140 to 180 kp/mm$^2$. The machining life of the resultant alloy was similar to that of standard P 10 alloy, but the amount of cratering was only 60% - 70% of the standard.

The invention is based upon the discovery of a fine-grained, four-phase, crater-resistant hardmetal, using the miscibility gap in the system TiC-ZrC, and as indicated above is not confined to the examples described. Thus, in accordance with a further feature, up to 40% of the hexagonal WC phase can be replaced by other hexagonal phase materials, such as Mo(C,N), (Mo,W) (C,N) and (Mo,W) C, and similarly, up to 40% of the ZrC can be replaced by HfC. In the systems TiC-HfC and TiC-ZrC-HfC, miscibility gaps also appear below 2000° C. Also substitution of carbon in the cubic phase is possible, by e.g. up to 20%, preferably up to 10% of nitrogen. A lightly nitrided (Ti-Zr-Nb)C mixed crystal, for instance has been shown to be very propitious for the desired spinodal decomposition.

Cobalt has proved beneficial as the iron group metal or alloy binder for the alloys. However, especially for alloys containing Mo, Ni alloys such as Ni-Co-Fe, Ni-Cr-Fe and Ni-Mo can be used to advantage.

We claim:

1. A sintered hardmetal which comprises tungsten carbide, a binder comprising one or more metals or alloys of the iron group and a mixed crystal material prepared by subjecting a mixture comprising zirconium and titanium carbides to heating at a temperature and for a time sufficient for the mixed crystal product to undergo spinodal decomposition upon cooling into a TiC-ZrC phase rich in TiC and a TiC-ZrC phase rich in ZrC, the amount of mixed crystal material present in the hardmetal being in the range from 2% to 40% by weight of the hardmetal.

2. A sintered hardmetal according to claim 1, wherein the mixed crystal material is present in an amount in the range from 5% to 30% by weight of the hardmetal.

3. A sintered hardmetal according to claim 1, wherein the mixed crystal material is obtained by alloying zirconium carbide with titanium carbide in amounts such that the resultant mixed crystal material comprises, in molar proportions, 5% to 80% of zirconium carbide and 95% to 20% of titanium carbide.

4. A sintered hardmetal according to claim 1, wherein the spinodally-decomposing mixed crystal material also includes one or more carbides of metals selected from Group Vb of the Periodic Table of the elements.

5. A sintered hardmetal according to claim 4, wherein the spinodally-decomposing mixed crystal material is derived from zirconium and titanium carbides together with at least one Group Vb metal carbide selected from niobium carbide, tantalum carbide and vanadium carbide present in the mixed crystal material in an amount in the range from 3% to 30% of the mixed crystal material.

6. A sintered hardmetal according to claim 4, which by weight contains about 90% tungsten carbide, 5% cobalt as the binder, 2.5% zirconium carbide, 1.5% titanium carbide, 0.2% vanadium carbide and 0.8% niobium carbide, the titanium, zirconium, vanadium and niobium carbides being derived from the spinodally decomposing mixed crystal material.

7. A sintered hardmetal according to claim 1, which by weight contains about 79% tungsten carbide, 8% cobalt as the binder, 5% zirconium carbide, 5% titanium carbide and 3% niobium carbide, the zirconium, titanium and niobium carbides and 1.5% of the tungsten carbide being derived from the spinodally decomposing mixed crystal material.

8. A sintered hardmetal according to claim 1, which by weight contains about 52% tungsten carbide, 8% cobalt as the binder, 12% titanium carbide, 8% zirconium carbide, 7% niobium carbide, 3% tantalum carbide and 10% molybdenum/tungsten carbonitrides (Mo,W) (C,N), the titanium, zirconium, niobium and tantalum carbides being derived from the spinodally-decomposing mixed crystal material.

9. A sintered hardmetal according to claim 1, which contains nitrogen in an amount by weight up to about 10% of the cubic carbide phase.

10. A sintered hardmetal according to claim 9, which contains at least one other hard material isomorphous with hexagonal tungsten carbide in an amount up to the amount of hexagonal tungsten carbide.

11. A sintered hardmetal according to claim 10, wherein the hard material isomorphous with tungsten carbide is selected from the carbides and carbonitrides of molybdenum and/or tungsten.

12. A process of manufacture of a sintered hardmetal having the constitution and properties defined in claim 1, which comprises (a) forming a first mixture comprising zirconium and titanium carbides in comminuted form, (b) heating the first mixture under such conditions that a first product is produced which contains zirconium and titanium carbides is mixed crystal form, such first mixed crystal product exhibiting spinodal decomposition upon cooling to yield a TiC-ZrC phase rich in TiC and a TiC-ZrC phase rich in ZrC, (c) forming a second mixture comprising tungsten carbide, the first product and, as a binder for the desired hardmetal, at least one metal or alloy of the iron group, the components of the second mixture all being in comminuted form, (d) heating the second mixture under such conditions that a second product is produced which comprises the desired sintered hardmetal containing, as binder, said at least one metal or alloy of the iron group and tungsten, zirconium and titanium carbides, wherein the spinodally-decomposed mixed crystal material is in the range from 2% to 40% by weight of the hardmetal.

13. A process according to claim 12, wherein said first product consists essentially of zirconium, titanium, vanadium and niobium carbides in the form of spinodally-decomposed mixed crystal material and the second mixture is formed by mixing said first product with tungsten carbide and cobalt, all the carbides being in comminuted form.

14. A process according to claim 12, wherein said first product consists essentially of zirconium, titanium, niobium and tungsten carbides in the form of spinodally-decomposed mixed crystal material and said second mixture is formed by mixing said first product with further tungsten carbide and cobalt.

15. A process according to claim 12, wherein said first product consists essentially of titanium, zirconium, niobium and tantalum carbides in the form of spinodally-decomposed mixed crystal material and said second mixture is formed by mixing the first product with tungsten carbide, molybdenum/tungsten carbonitrides (Mo,W) (C,N) and cobalt.

* * * * *